US010398282B2

(12) United States Patent
Dingert et al.

(10) Patent No.: US 10,398,282 B2
(45) Date of Patent: Sep. 3, 2019

(54) TRAPEZOIDAL MOP COVER

(71) Applicant: Carl Freudenberg KG, Weinheim (DE)

(72) Inventors: Uwe Dingert, Absteinach (DE); Norbert Weis, Weinheim (DE); Hannsgeorg Wolf, Weinheim (DE); Sabine Wilmes, Anroechte (DE); Susanne Walter, Gorxheimertal (DE)

(73) Assignee: CARL FREUDENBERG KG, Weinheim (DE)

( * ) Notice: Subject to any disclaimer, the term of this patent is extended or adjusted under 35 U.S.C. 154(b) by 225 days.

(21) Appl. No.: 15/317,422

(22) PCT Filed: Jun. 1, 2015

(86) PCT No.: PCT/EP2015/062142
§ 371 (c)(1),
(2) Date: Dec. 9, 2016

(87) PCT Pub. No.: WO2015/197314
PCT Pub. Date: Dec. 30, 2015

(65) Prior Publication Data

US 2017/0119228 A1 May 4, 2017

(30) Foreign Application Priority Data

Jun. 23, 2014 (DE) ..... 10 2014 008 954

(51) Int. Cl.
*A47L 13/44* (2006.01)
*A47L 13/16* (2006.01)
(Continued)

(52) U.S. Cl.
CPC ..... *A47L 13/44* (2013.01); *A47L 13/16* (2013.01); *A47L 13/256* (2013.01); *A47L 13/258* (2013.01)

(58) Field of Classification Search
CPC ..... A47L 13/44; A47L 13/16; A47L 13/256; A47L 13/258; A47L 13/24
See application file for complete search history.

(56) References Cited

U.S. PATENT DOCUMENTS 3,761,991 A * 10/1973 Moss ..... A47L 13/16 15/209.1
8,464,391 B2 * 6/2013 Bober ..... A47L 13/256 15/147.1

(Continued)

FOREIGN PATENT DOCUMENTS

DE 9308947 U1 8/1993
DE 9411092 U1 9/1994

(Continued)

*Primary Examiner* — Shay Karls
(74) *Attorney, Agent, or Firm* — Leydig, Voit & Mayer, Ltd.

(57) ABSTRACT

A mop cover has a planar main body with four outer edges, wherein a longer first outer edge is oriented parallel to a longer second outer edge, the first outer edge being longer than the second outer edge, two shorter outer edges respectively extending between the longer outer edges, the main body having at least two pockets, into which mop wings or tensioning elements can be introduced to tense the planar main body, being configured such that the mop cover can be readily gripped, and tensioned, by rectangular wings, wherein the mop cover can be guided effectively for cleaning purposes with the greatest possible degrees of freedom in corner regions, a mop cover of the type mentioned in the introduction is characterized in that at least one outer edge and/or at least one pocket are/is assigned at least one stiffening element for the partially reinforced stiffening of the main body.

18 Claims, 7 Drawing Sheets

(51) Int. Cl.
*A47L 13/258* (2006.01)
*A47L 13/256* (2006.01)

(56) References Cited

U.S. PATENT DOCUMENTS

| | | | | |
|---|---|---|---|---|
| 9,386,898 | B2 * | 7/2016 | Masquin | A47L 13/14 |
| 9,468,354 | B2 * | 10/2016 | Salmon | A47L 13/258 |
| 2014/0007365 | A1 | 1/2014 | Salmon | |
| 2016/0150939 | A1 * | 6/2016 | Wilmes | A47L 13/20 15/247 |

FOREIGN PATENT DOCUMENTS

| | | | |
|---|---|---|---|
| DE | 202011101141 | U1 | 8/2012 |
| EP | 1097667 | A1 | 5/2001 |
| EP | 1166706 | A1 | 1/2002 |
| JP | 2011041736 | A | 3/2011 |

* cited by examiner

TRAPEZOIDAL MOP COVER

CROSS-REFERENCE TO RELATED APPLICATIONS

This application is a U.S. national stage application under 35 U.S.C. § 371 of International Application No. PCT/EP2015/062142, filed on Jun. 1, 2015, and claims benefit to German Patent Application No. DE 10 2014 008 954.1, filed on Jun. 23, 2014. The International Application was published in German on Dec. 30, 2015, as WO 2015/197314 A1 under PCT Article 21(2).

FIELD

The invention relates to a mop cover.

BACKGROUND

Mops comprising foldable wings are known from the prior art. These wings are inserted into pockets in mop covers and oriented in parallel such that the mop covers are stretched out.

In particular, mops of which the wings have free trapezoidal ends are known from the prior art. FIG. 1 shows a mop of this type. It can be seen from FIG. 1 that it may be difficult to insert and spread out the wings, because the wings ultimately rest on the floor by a tip. The wings can easily tilt about this tip when a force directed towards the floor is exerted on the wings.

It is much easier to insert and spread out wings having rectangular free ends, as is shown in FIG. 2, because these wings rest on the floor in a straight line.

If, however, rectangular wings of this type are inserted into a trapezoidal mop cover, regions of the pockets or of the mop cover might still not be filled by the wings and might therefore be unstable and not sufficiently fit for purpose in some cleaning applications.

SUMMARY

An aspect of the invention provides a mop cover, comprising: a planar main body including a first, second, third, and fourth outer edge, wherein the first outer edge is longer than other outer edges and oriented in parallel with a second, also longer, outer edge, the first outer edge being longer than the second outer edge, wherein the third and fourth outer edges, which are shorter than the first and second outer edges, each extend between the first and second outer edges, wherein the main body further includes a first and a second pocket, configured such that, one or more wings or tensioning elements of a mop can be inserted into the pockets in order to stretch out the planar main body, wherein at least one of the outer edges and/or pockets includes a stiffening element, configured to provide increased stiffening to regions of the main body.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

An aspect of the invention is therefore to design and develop a mop cover of the type mentioned at the outset such that said mop cover can be gripped and stretched out by rectangular wings without any problems, it being possible to effectively guide the mop cover into corner regions for cleaning purposes with as many degrees of freedom as possible.

According to an aspect of the invention, it has been identified that at least one stiffening element for increased stiffening of regions of the main body has to be associated with at least one outer edge and/or at least one pocket so that said at least one outer edge and/or at least one pocket is sufficiently stable when the pocket is not completely filled. The stiffening element assumes the filling and supporting function of a wing even when said wing does not completely fill the pocket. As a result, the mop cover can be gripped and stretched out without any problems by means of rectangular wings, it being possible to effectively guide the mop cover into corner regions for cleaning purposes with as many degrees of freedom as possible.

In the light of the above, a stiffening element could make the main body stable in a region adjoining a pocket such that the main body retains its geometric shape in a self-supporting manner in this region, even if a wing having a rectangular free end is received in the pocket or if a wing not having a trapezoidal free end is received therein. Owing to this design, clips or wires can also be inserted into the pockets instead of wings, without making the mop cover significantly less fit for purpose.

A stiffening element could be produced or shaped from a synthetic sheet or from a plastics sheet. A stiffening element of this type can be manufactured in a cost-effective and simple manner, for example by means of punching or cutting.

A stiffening element could completely overlap a pocket, as a result of which the mop cover would be stabilized in a particularly strong manner.

A stiffening element could partially overlap a pocket, thereby saves on material for the stiffening element.

A stiffening element could be strip-shaped, run along a longer outer edge and extend as far as to a corner region of the longer outer edge which a shorter outer edge joins. The strip shape significantly reduces the amount of synthetic or plastics material required for the stiffening element.

Two stiffening elements could be opposite one another in mirror image with respect to an axis of symmetry. In this way, it is particularly easy to produce a mop cover and it is easier to store the stiffening elements.

A mop could comprise a mop cover of the type described herein and two wings that can pivot relative to one another and each have a rectangular free end. A mop of this type can be used together with a trapezoidal mop cover without any problems. This makes cleaning corner regions significantly easier.

Figure 1:
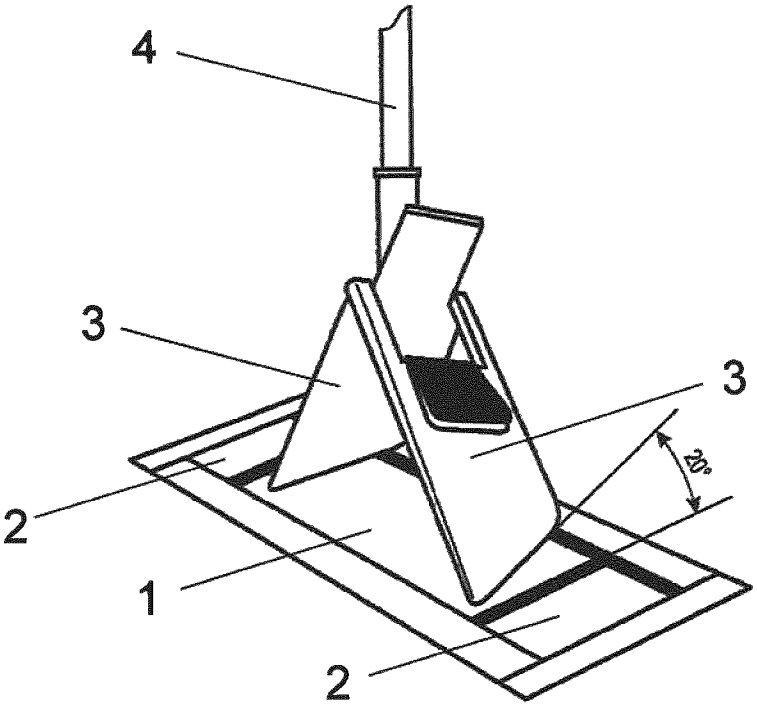
FIG. 1 shows a mop comprising foldable wings, the free ends of the wings being trapezoidal and inserted into the pockets in a rectangular mop cover.

FIG. 1 shows a rectangular mop cover 1, into the pockets 2 of which two pivotable wings 3 of a mop 4 are inserted. The free ends of the wings 3 are trapezoidal and rest on the floor in a point. As a result, the wings 3 may tilt, making it more difficult to insert the wings 3 into the pockets 2 and to spread said wings out.

Figure 2:
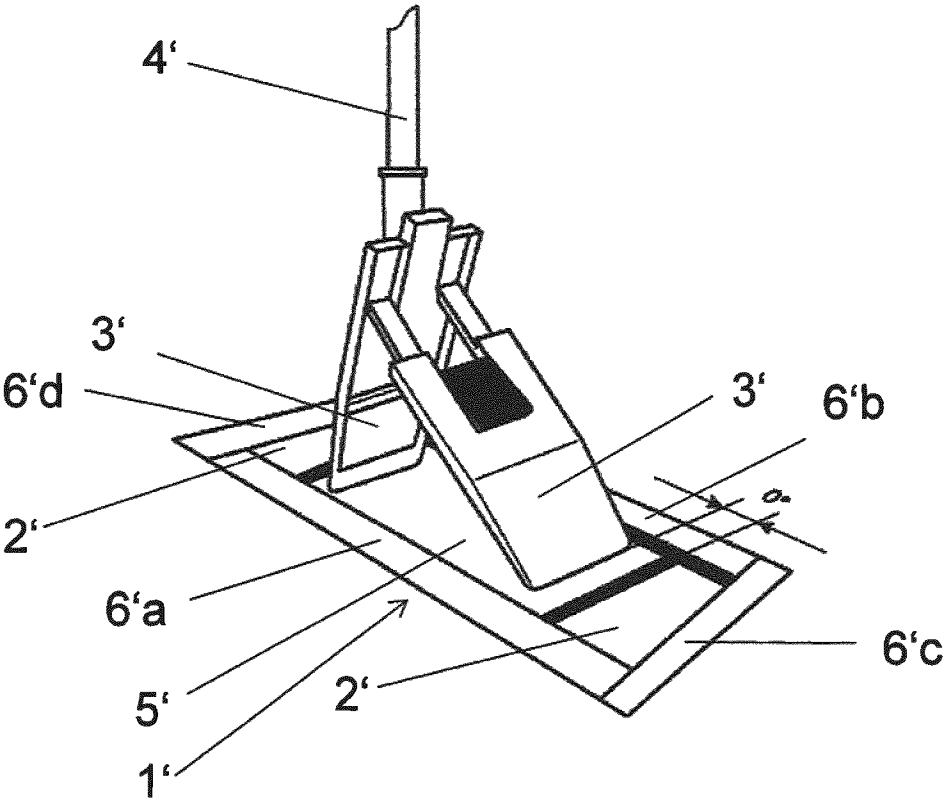
FIG. 2 shows a mop comprising foldable wings, the free ends of the wings being rectangular and inserted into the pockets in a trapezoidal mop cover.

FIG. 2 shows a mop cover 1' comprising a planar main body 5' having four outer edges 6'*a*, 6'*b*, 6'*c*, 6'*d*, a first longer outer edge 6'*a* being oriented in parallel with a second longer outer edge 6'*b*, the first longer outer edge 6'*a* being longer than the second longer outer edge 6'*b*, two shorter outer edges 6'*c*, 6'*d* each extending between the longer outer edges 6'*a*, 6'*b*, and at least two pockets 2' being associated with the main body 5', into which pockets wings 3' or tensioning elements of a mop 4' can be inserted in order to stretch out the planar main body 5'.

The free ends of the wings 3' are rectangular and each lie on a line when inserted into the pockets 2', namely on the edge thereof that is closest the ground. The wings 3' do not completely fill the trapezoidal pockets 2'. In this case, edge regions of the mop cover 1' cannot be sufficiently stable to guide the edges into corners in a manner which produces good cleaning results.

Figure 3:
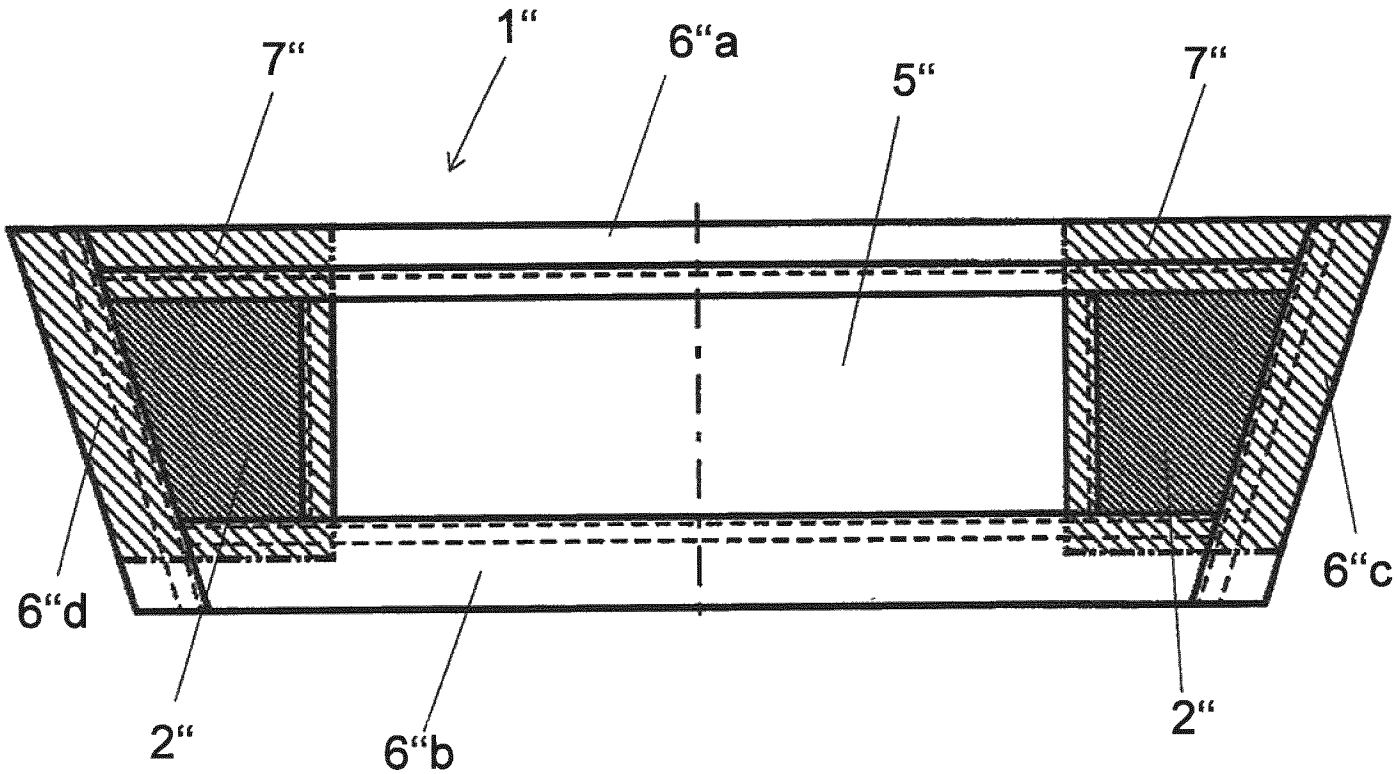
FIG. 3 shows a trapezoidal mop cover, the pockets of which are each associated a trapezoidal stiffening element, the pockets being completely covered by the stiffening elements.
Figure 4:
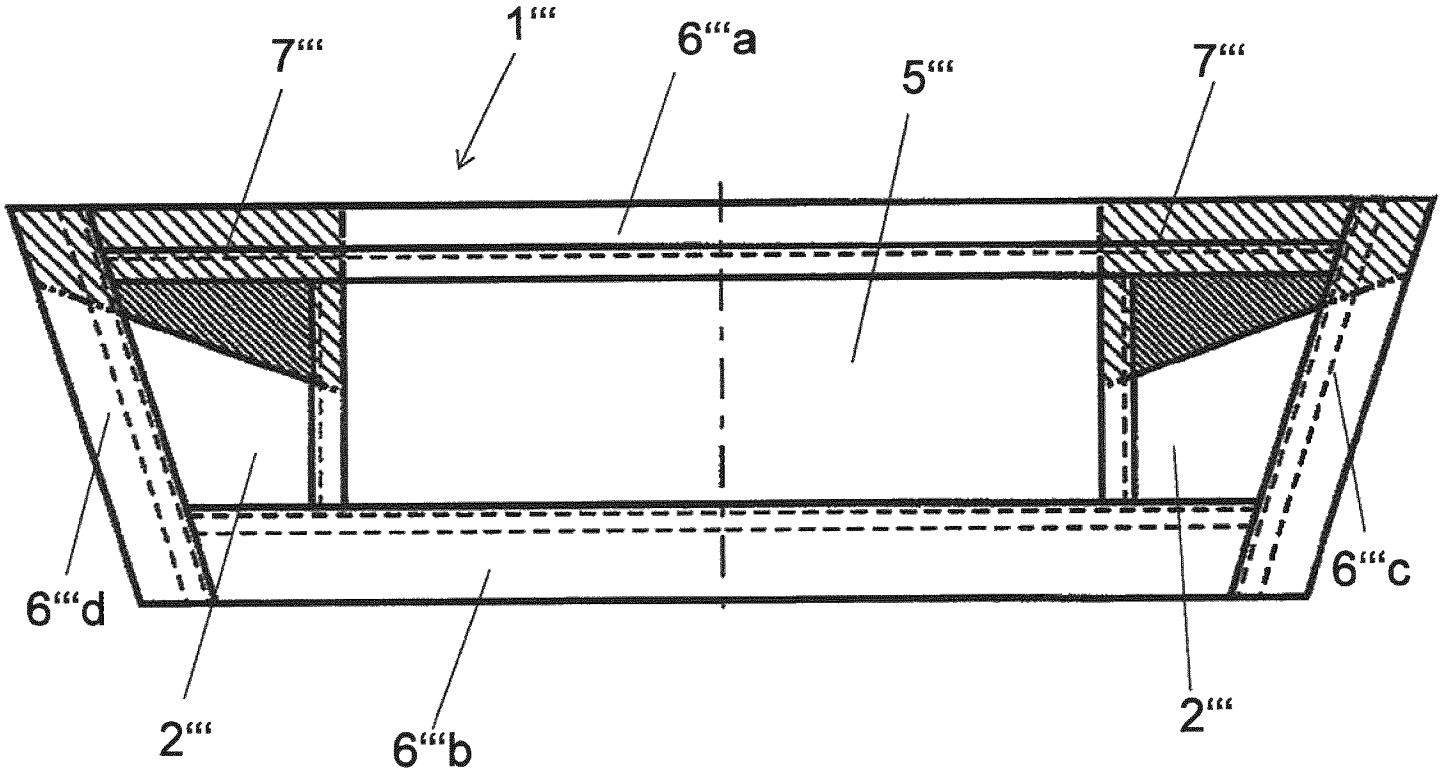
FIG. 4 shows another trapezoidal mop cover, the pockets of which are each associated a stiffening element which only partially covers the pockets.
Figure 5:
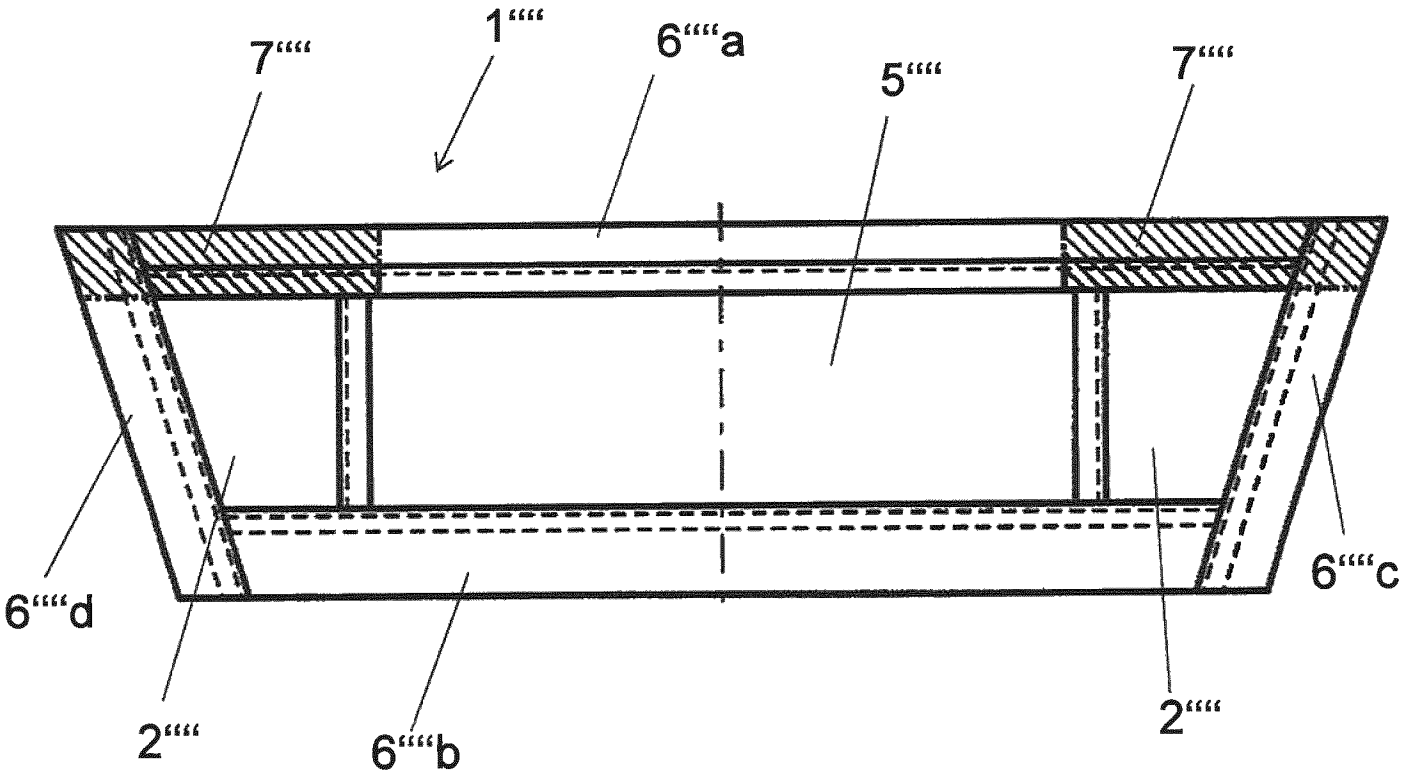
FIG. 5 shows another trapezoidal mop cover, the first longer outer edge of which is associated with two opposite strip-shaped stiffening elements.

Therefore, stiffening elements 7", 7''', 7"" are associated with the mop covers 1", 1''', 1"" in FIGS. 3 to 5. At least one stiffening element 7", 7''', 7"" for increased stiffening of regions of the main body 5", 5''', 5"" is associated with at least one outer edge 6"*a*, 6"*b*, 6"*c*, 6"*d*, 6'''*a*, 6'''*b*, 6'''*c*, 6'''*d*, 6""*a*, 6""*b*, 6""*c*, 6""*d* and/or at least one pocket 2', ''', 2"".

A stiffening element 7", 7''', 7"" makes the main body 5", 5''', 5"" stable in a region adjoining a pocket 2", 2''', 2"" such that the main body 5", 5''', 5"" retains its geometric shape in a self-supporting manner in this region, even if a wing 3' having a rectangular free end is received in the pocket 2", 2''', 2"" or if a wing not having a trapezoidal free end is received therein.

The stiffening element 7", 7''', 7"" is produced or shaped from a synthetic sheet or plastics sheet.

FIG. 3 shows that each stiffening element 7" completely overlaps one pocket 2". The two pockets 2" are completely overlapped.

FIG. 4 shows that a stiffening element 7''' partially overlaps a pocket 2'''. The two pockets 2''' are partially overlapped.

FIG. 5 shows that a stiffening element 7"" is strip-shaped, runs along a longer outer edge 6""*a* and extends as far as to a corner region of the longer outer edge 6""*a*, which a shorter outer edge 6""*c* or 6""*d* joins.

In FIGS. 3 to 5, two stiffening elements 7", 7''', 7"" are opposite one another in mirror image with respect to an axis of symmetry.

Figure 6:
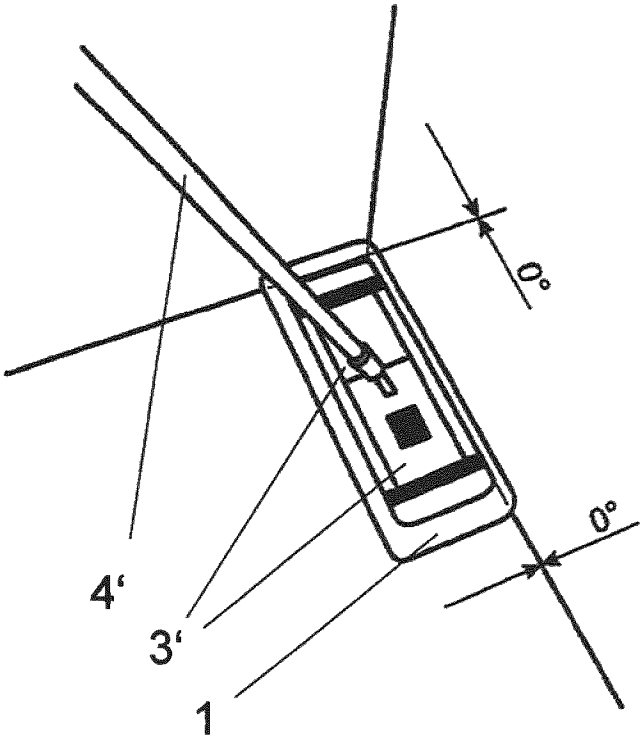
FIG. 6 is a view showing that a stretched-out rectangular mop cover is practically not pivotable in corner regions.

FIG. 6 shows a mop 4' comprising a rectangular mop cover 1 and two wings 3' that can pivot relative to one another and each have a rectangular free end. A mop 4' of this type has practically no degrees of pivotal freedom in corner regions.

Figure 7:
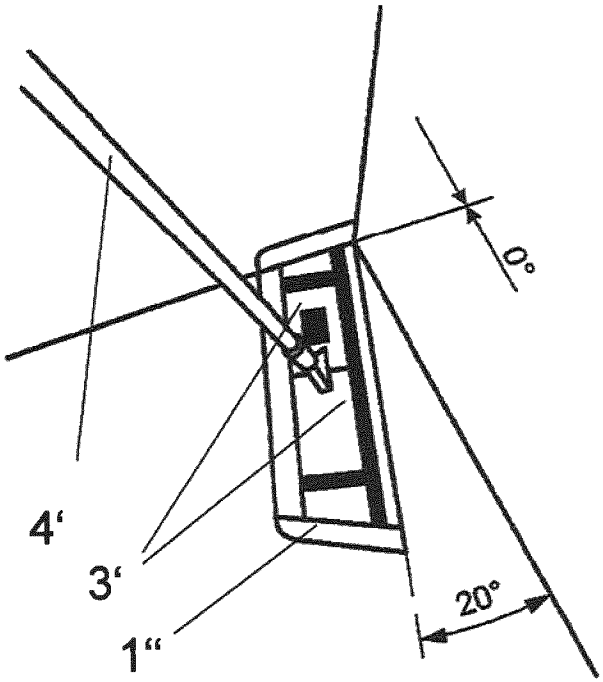
FIG. 7 is a view showing that a stretched-out trapezoidal mop cover is pivotable in corner regions.

By contrast, FIG. 7 shows a mop 4' which comprises a trapezoidal mop cover 1" and two wings 3' that can pivot relative to one another and each have a rectangular free end. A mop 4' of this type has at least one degree of pivotal freedom in corner regions. The mop cover 1" can be held in a corner by a tip, and pivoted about this tip. The pivoting angle in this case is 20°.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A mop cover, comprising:

a planar main body including a first, second, third, and fourth outer edge, wherein the first outer edge is longer than other outer edges and oriented in parallel with the second, also longer, outer edge, the first outer edge being longer than the second outer edge, wherein the third and fourth outer edges, which are shorter than the first and second outer edges, each extend between the first and second outer edges, wherein the main body further includes a first and a second pocket, configured such that, one or more wings or tensioning elements of a mop can be inserted into the pockets in order to stretch out the planar main body, wherein at least one of the outer edges and/or pockets includes at least one stiffening element, configured to provide increased stiffening to regions of the main body.

2. The cover of claim 1, wherein the at least one stiffening element makes the main body stable in a region adjoining either the first or the second pocket such that the main body retains its geometric shape in a self-supporting manner in this region, even if the one or more wings having a rectangular free end is received in the pocket or if the one or more wings not having a trapezoidal free end is received therein.

3. The cover of claim 1, wherein the stiffening element is produced or shaped from a synthetic sheet or from a plastic sheet.

4. The cover of claim 1, wherein the stiffening element completely overlaps at least the first or the second pocket.

5. The cover of claim 1, wherein the stiffening element partially overlaps at least the first or the second pocket.

6. The cover of claim 1, wherein the stiffening element is strip-shaped, runs along either the first or second outer edge, and extends as far as to a corner region of the first or second outer edge which a shorter outer edge joins.

7. The cover of claim 1, wherein the at least one stiffening element comprises two stiffening elements, and wherein the two stiffening elements are opposite one another in mirror image with respect to an axis of symmetry.

8. A mop, comprising:

the mop cover of claim 1; and a first and a second wing, which wings can pivot relative to one another and each include a rectangular free end.

9. The cover of claim 1, wherein at least one of the outer edges includes the at least one stiffening element.

10. The cover of claim 9, wherein the at least one stiffening element comprises a first stiffening element, the first stiffening element being the at least one stiffening element included with the at least one of the outer edges, and a second stiffening element, and wherein at least one of the pockets includes the second stiffening element.

11. The cover of claim 1, wherein at least one of the pockets includes the at least one stiffening element.

12. The cover of claim 1, wherein the at least one stiffening element comprises a plurality of stiffening elements, and wherein two or more of the outer edges each include one of the plurality of stiffening elements.

13. The cover of claim 12, wherein two or more of the pockets each include one of the plurality of stiffening elements.

14. The cover of claim 1, wherein the at least one stiffening element comprises a plurality of stiffening elements, and wherein two or more of the pockets each include one of the plurality of stiffening elements.

15. The cover of claim 1, wherein the stiffening element includes a synthetic.

16. The cover of claim 1, wherein the stiffening element includes a plastic.

17. The cover of claim 1, wherein the stiffening element includes a sheet including a synthetic.

18. The cover of claim 1, wherein the stiffening element includes a sheet including a plastic.

* * * * *